US005933683A

United States Patent [19]

Snelling et al.

[11] Patent Number: 5,933,683

[45] Date of Patent: Aug. 3, 1999

[54] APPARATUS AND METHOD FOR NON-INTERACTIVE MAGNETIC BRUSH DEVELOPMENT

[75] Inventors: Christopher Snelling, Penfield; Dale R. Mashtare, Macedon, both of N.Y.

[73] Assignee: Xerox Corporation, Stamford, Conn.

[21] Appl. No.: 09/004,465

[22] Filed: Jan. 8, 1998

[51] Int. Cl.[6] ..... G03L 15/09

[52] U.S. Cl. ..... 399/53; 399/267

[58] Field of Search ..... 399/49, 53, 267, 399/277

[56] References Cited

U.S. PATENT DOCUMENTS 4,357,103 11/1982 Kroll ..... 399/267

4,862,828 9/1989 Kumasaka et al. ..... 399/267

*Primary Examiner*—Joan Pendegrass

*Attorney, Agent, or Firm*—Lloyd F. Bean, II

[57] ABSTRACT

A development system including a developer transport adapted for depositing developer material on an imaging surface having an electrostatic latent image thereon, including a housing defining a chamber storing a supply of developer material including toner. A donor member is mounted partially in said chamber and spaced from the imaging surface, for transporting developer on an outer surface thereof to a region opposed from the imaging surface. The donor member has a magnetic assembly, which includes a plurality of poles, and a sleeve, enclosing said magnetic assembly and rotating about said magnetic assembly. A sensor measures a magnetic field of said donor roll at a predefined position on said donor roll. A magnetic system generates a magnetic field to reduce developer bed height of said developer material on said donor member in a development zone.

3 Claims, 5 Drawing Sheets

APPARATUS AND METHOD FOR NON-INTERACTIVE MAGNETIC BRUSH DEVELOPMENT

BACKGROUND OF THE PRESENT INVENTION

The invention relates generally to an electrophotographic printing machine and, more particularly, to a development system which includes a magnetic developer roll for transporting developer material to a development zone; and a magnetic system for generating a magnetic field to reduce developer material bed height in the development zone.

The following application is incorporated herein by reference: patent application Ser. No. 09/004,464, entitled, "APPARATUS AND METHOD FOR NON-INTERACTIVE MAGNETIC BRUSH DEVELOPMENT", which has been filed concurrently.

Generally, an electrophotographic printing machine includes a photoconductive member which is charged to a substantially uniform potential to sensitize the surface thereof. The charged portion of the photoconductive member is exposed to an optical light pattern representing the document being produced. This records an electrostatic latent image on the photoconductive member corresponding to the informational areas contained within the document. After the electrostatic latent image is formed on the photoconductive member, the image is developed by bringing a developer material into proximal contact therewith. Typically, the developer material comprises toner particles adhering triboelectrically to carrier granules. The toner particles are attracted to the latent image from the carrier granules and form a powder image on the photoconductive member which is subsequently transferred to a copy sheet. Finally, the copy sheet is heated or otherwise processed to permanently affix the powder image thereto in the desired image-wise configuration.

In the prior art, both interactive and non-interactive development has been accomplished with magnetic brushes. In typical interactive embodiments, the magnetic brush is in the form of a rigid cylindrical sleeve which rotates around a fixed assembly of permanent magnets. In this type development system, the cylindrical sleeve is usually made of an electrically conductive, non-ferrous material such as aluminum or stainless steel, with its outer surface textured to improve developer adhesion. The rotation of the sleeve transports magnetically adhered developer through the development zone where there is direct contact between the developer brush and the imaged surface, and toner is stripped from the passing magnetic brush filaments by the electrostatic fields of the image.

Non-interactive development is most useful in color systems when a given color toner must be deposited on an electrostatic image without disturbing previously applied toner deposits of a different color or cross-contaminating the color toner supplies.

It has been observed that the magnetic brush height formed by the developer mass in the magnetic fields on the sleeve surface in this type development system is periodic in thickness and statistically noisy as a result of complex carrier bead agglomeration and filament exchange mechanisms that occur during operation. As a result, substantial clearance must be provided in the development gap to avoid photoreceptor interactions through direct physical contact, so that the use of a closely spaced developer bed critical to high fidelity image development is precluded.

The magnetic pole spacing cannot be reduced to an arbitrarily small size because allowance for the thickness of the sleeve and a reasonable mechanical clearance between the sleeve and the rotating magnetic core sets a minimum working range for the magnetic multipole forces required to both hold and tumble the developer blanket on the sleeve. Since the internal pole geometry defining the spatial wavelength of the tumbling component also governs the magnitude of the holding forces for the developer blanket at any given range, there is only one degree of design freedom available to satisfy the opposing system requirements of short spatial wavelength and strong holding force. Reducing the developer blanket mass by supply starvation has been found to result in a sparse brush structure without substantially reducing the brush filament lengths or improving the uneven length distribution.

SUMMARY OF THE INVENTION

The present invention obviates the problems noted above by utilizing a development system including a non-interactive magnetic brush development method employing a harmonic rotating multipole magnetic core within a passive sleeve to provide a regular matrix of surface gradients that attract permanently magnetic carrier to the sleeve. As the core rotates in one direction within the sleeve, the magnetic fields forming the brush filaments of developer material cause the material to walk on the sleeve in a direction opposite of that of the core. The collective tumbling action of the filaments transports bulk developer material along the sleeve surface. The mechanical agitation and shearing effects inherent in the rotating filaments reduces adhesion of the toner particles to the carrier beads that form the brush filaments making them available for transport across a gap to the photoreceptor surface under the influence of the proximal development fields of the image. There is provided a development system including a developer transport adapted for depositing toner material onto an imaging surface having an electrostatic latent image thereon, comprising a housing defining a chamber storing a supply of developer material comprising toner; a donor member, mounted partially in said chamber and spaced from the imaging surface, for transporting developer on an outer surface thereof to a region opposed from the imaging surface, said donor member having a magnetic assembly having a plurality of poles, a sleeve, enclosing said magnetic assembly, rotating about said magnetic assembly; a sensor for measuring the magnetic field of said donor roll at a predefined position on said donor roll; and means for generating a magnetic field to reduce developer bed height of said developer material on said donor member.

Inasmuch as the art of electrophotographic printing is well known, the various processing stations employed in the printing machine will be shown hereinafter schematically and their operation described briefly with reference thereto.

Figure 1:
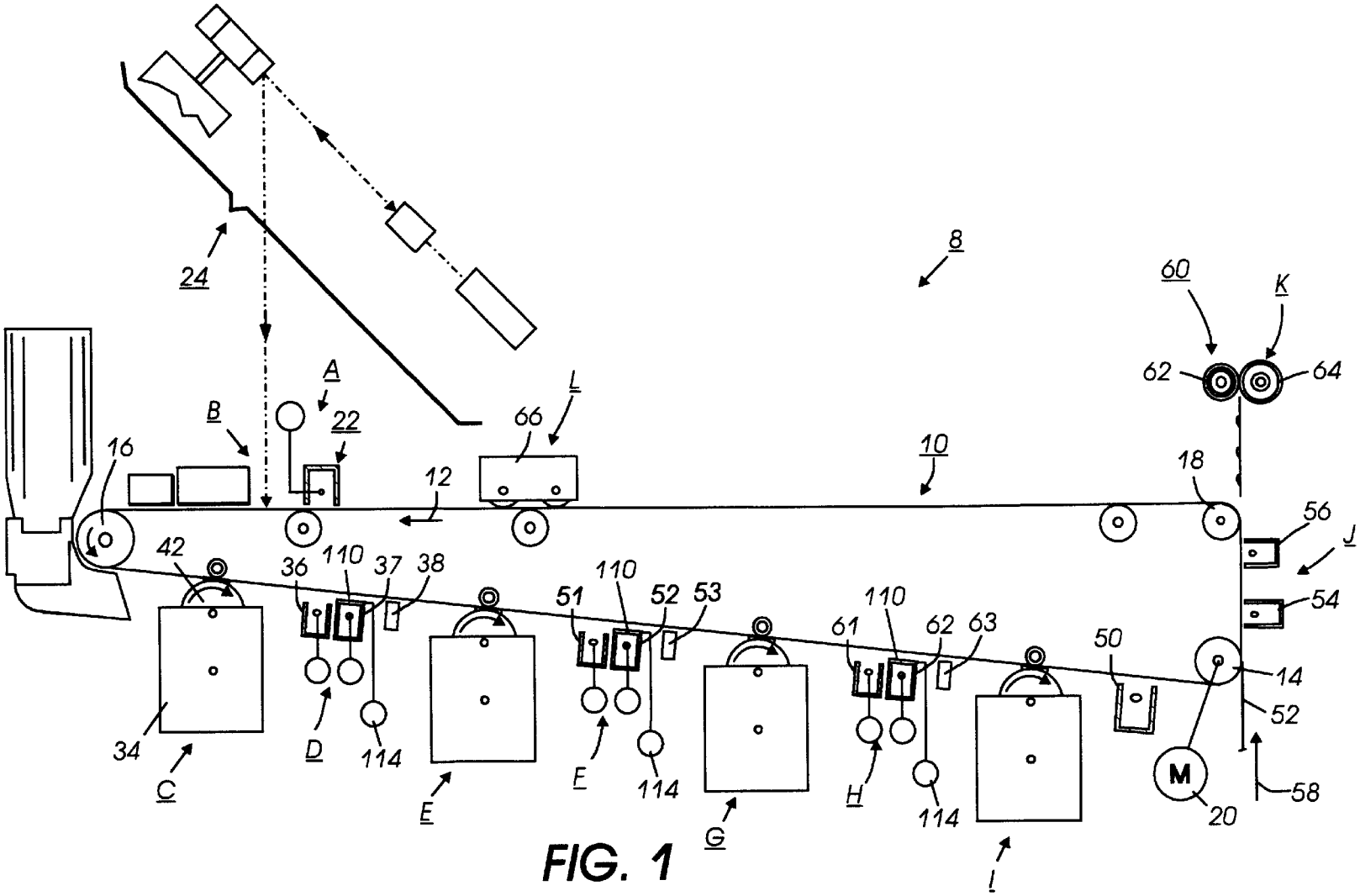
FIG. 1 is a schematic elevational view of an illustrative electrophotographic printing or imaging machine or apparatus incorporating a development apparatus having the features of the present invention therein.

Referring initially to FIG. 1, there is shown an illustrative electrophotographic machine having incorporated therein the development apparatus of the present invention. An electrophotographic printing machine 8 creates a color image in a single pass through the machine and incorporates the features of the present invention. The printing machine 8 uses a charge retentive surface in the form of an Active Matrix (AMAT) photoreceptor belt 10 which travels sequentially through various process stations in the direction indicated by the arrow 12. Belt travel is brought about by mounting the belt about a drive roller 14 and two tension rollers 16 and 18 and then rotating the drive roller 14 via a drive motor 20.

As the photoreceptor belt moves, each part of it passes through each of the subsequently described process stations. For convenience, a single section of the photoreceptor belt, referred to as the image area, is identified. The image area is that part of the photoreceptor belt which is to receive the toner powder images which, after being transferred to a substrate, produce the final image. While the photoreceptor belt may have numerous image areas, since each image area is processed in the same way, a description of the typical processing of one image area suffices to fully explain the operation of the printing machine.

Figure 2A:
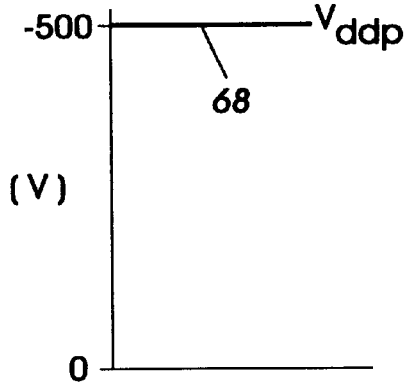
FIG. 2A shows a typical voltage profile of an image area in the electrophotographic printing machines illustrated in FIG. 1 after that image area has been charged.

As the photoreceptor belt 10 moves, the image area passes through a charging station A. At charging station A, a corona generating device, indicated generally by the reference numeral 22, charges the image area to a relatively high and substantially uniform potential. FIG. 2A illustrates a typical voltage profile 68 of an image area after that image area has left the charging station A. As shown, the image area has a uniform potential of about −500 volts. In practice, this is accomplished by charging the image area slightly more negative than −500 volts so that any resulting dark decay reduces the voltage to the desired −500 volts. While FIG. 2A shows the image area as being negatively charged, it could be positively charged if the charge levels and polarities of the toners, recharging devices, photoreceptor, and other relevant regions or devices are appropriately changed.

Figure 2B:
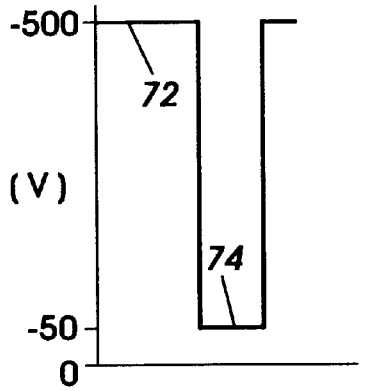
FIG. 2B shows a typical voltage profile of the image area after being exposed.

After passing through the charging station A, the now charged image area passes through a first exposure station B. At exposure station B, the charged image area is exposed to light which illuminates the image area with a light representation of a first color (say black) image. That light representation discharges some parts of the image area so as to create an electrostatic latent image. While the illustrated embodiment uses a laser based output scanning device 24 as a light source, it is to be understood that other light sources, for example an LED printbar, can also be used with the principles of the present invention. FIG. 2B shows typical voltage levels, the levels 72 and 74, which might exist on the image area after exposure. The voltage level 72, about −500 volts, exists on those parts of the image area which were not illuminated, while the voltage level 74, about −50 volts, exists on those parts which were illuminated. Thus after exposure, the image area has a voltage profile comprised of relative high and low voltages.

After passing through the first exposure station B, the now exposed image area passes through a first development station C which is identical in structure with development system E, G, and I. The first development station C deposits a first color, say black, of negatively charged toner 31 onto the image area. That toner is attracted to the less negative sections of the image area and repelled by the more negative sections. The result is a first toner powder image on the image area.

For the first development station C, development system 34 includes a donor roll 42. Donor roll 42 is mounted, at least partially, in the chamber of developer housing 44. The chamber in developer housing 44 stores a supply of developer (toner) material that develops the image.

Figure 2C:
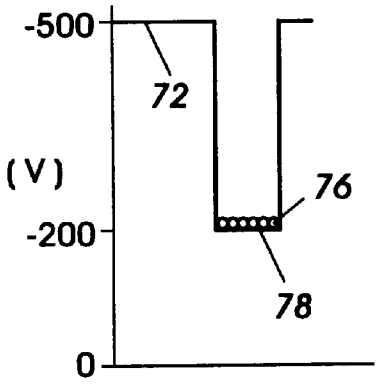
FIG. 2C shows a typical voltage profile of the image area after being developed.

FIG. 2C shows the voltages on the image area after the image area passes through the first development station C. Toner 76 (which generally represents any color of toner) adheres to the illuminated image area. This causes the voltage in the illuminated area to increase to, for example, about −200 volts, as represented by the solid line 78. The unilluminated parts of the image area remain at about the level 72.

After passing through the first development station C, the now exposed and toned image area passes to a first recharging station D. The recharging station D is comprised of two corona recharging devices, a first recharging device 36 and a second recharging device 37, which act together to recharge the voltage levels of both the toned and untoned parts of the image area to a substantially uniform level. It is to be understood that power supplies are coupled to the first and second recharging devices 36 and 37, and to any grid or other voltage control surface associated therewith, as required so that the necessary electrical inputs are available for the recharging devices to accomplish their task.

Figure 2D:
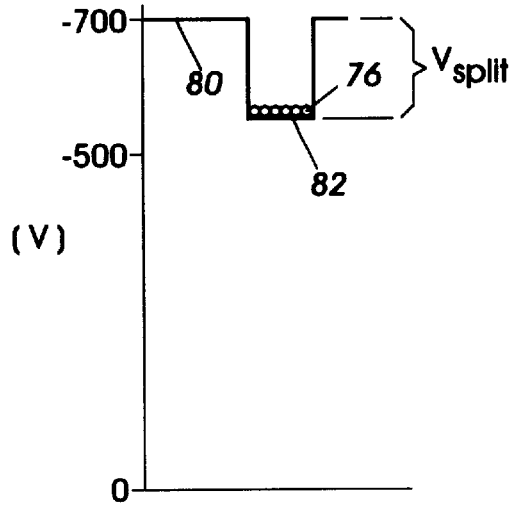
FIG. 2D shows a typical voltage profile of the image area after being recharged by a first recharging device.

FIG. 2D shows the voltages on the image area after it passes through the first recharging device 36. The first recharging device overcharges the image area to more negative levels than that which the image area is to have when it leaves the recharging station D. For example, as shown in FIG. 2D the toned and the untoned parts of the image area, reach a voltage level 80 of about −700 volts. The first recharging device 36 is preferably a DC scorotron.

Figure 2E:
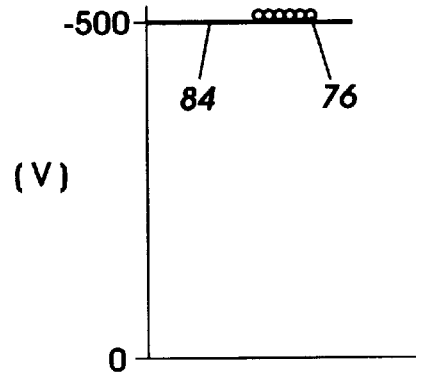
FIG. 2E shows a typical voltage profile of the image area after being recharged by a second recharging device.

After being recharged by the first recharging device 36, the image area passes to the second recharging device 37. Referring now to FIG. 2E, the second recharging device 37 reduces the voltage of the image area, both the untoned parts and the toned parts (represented by toner 76) to a level 84 which is the desired potential of −500 volts.

Figure 2F:
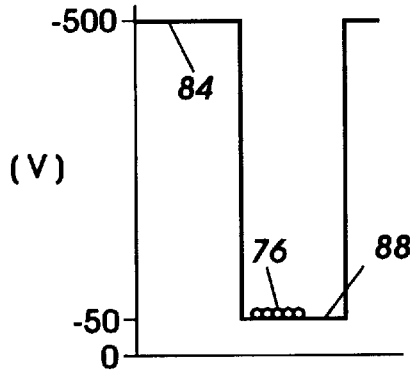
FIG. 2F shows a typical voltage profile of the image area after being exposed for a second time.

After being recharged at the first recharging station D, the now substantially uniformly charged image area with its first toner powder image passes to a second exposure station 38. Except for the fact that the second exposure station illuminates the image area with a light representation of a second color image (say yellow) to create a second electrostatic latent image, the second exposure station 38 is the same as the first exposure station B. FIG. 2F illustrates the potentials on the image area after it passes through the second exposure station. As shown, the non-illuminated areas have a potential about −500 as denoted by the level 84. However, illuminated areas, both the previously toned areas denoted by the toner 76 and the untoned areas are discharged to about −50 volts as denoted by the level 88.

The image area then passes to a second development station E. Except for the fact that the second development station E contains a toner 40 which is of a different color (yellow) than the toner 31 (black) in the first development station C, the second development station is beneficially the same as the first development station. Since the toner 40 is attracted to the less negative parts of the image area and repelled by the more negative parts, after passing through the second development station E the image area has first and second toner powder images which may overlap.

The image area then passes to a second recharging station F. The second recharging station F has first and second recharging devices, the devices 51 and 52, respectively, which operate similar to the recharging devices 36 and 37. Briefly, the first corona recharge device 51 overcharges the image areas to a greater absolute potential than that ultimately desired (say −700 volts) and the second corona recharging device, comprised of coronodes having AC potentials, neutralizes that potential to that ultimately desired.

The now recharged image area then passes through a third exposure station 53. Except for the fact that the third exposure station illuminates the image area with a light representation of a third color image (say magenta) so as to create a third electrostatic latent image, the third exposure station 38 is the same as the first and second exposure stations B and 38. The third electrostatic latent image is then developed using a third color of toner 55 (magenta) contained in a third development station G.

The now recharged image area then passes through a third recharging station H. The third recharging station includes a pair of corona recharge devices 61 and 62 which adjust the voltage level of both the toned and untoned parts of the image area to a substantially uniform level in a manner similar to the corona recharging devices 36 and 37 and recharging devices 51 and 52.

After passing through the third recharging station the now recharged image area then passes through a fourth exposure station 63. Except for the fact that the fourth exposure station illuminates the image area with a light representation of a fourth color image (say cyan) so as to create a fourth electrostatic latent image, the fourth exposure station 63 is the same as the first, second, and third exposure stations, the exposure stations B, 38, and 53, respectively. The fourth electrostatic latent image is then developed using a fourth color toner 65 (cyan) contained in a fourth development station I.

To condition the toner for effective transfer to a substrate, the image area then passes to a pretransfer corotron member 50 which delivers corona charge to ensure that the toner particles are of the required charge level so as to ensure proper subsequent transfer.

After passing the corotron member 50, the four toner powder images are transferred from the image area onto a support sheet 52 at transfer station J. It is to be understood that the support sheet is advanced to the transfer station in the direction 58 by a conventional sheet feeding apparatus which is not shown. The transfer station J includes a transfer corona device 54 which sprays positive ions onto the backside of sheet 52. This causes the negatively charged toner powder images to move onto the support sheet 52. The transfer station J also includes a detack corona device 56 which facilitates the removal of the support sheet 52 from the printing machine 8.

After transfer, the support sheet 52 moves onto a conveyor (not shown) which advances that sheet to a fusing station K. The fusing station K includes a fuser assembly, indicated generally by the reference numeral 60, which permanently affixes the transferred powder image to the support sheet 52. Preferably, the fuser assembly 60 includes a heated fuser roller 62 and a backup or pressure roller 64. When the support sheet 52 passes between the fuser roller 62 and the backup roller 64 the toner powder is permanently affixed to the sheet support 52. After fusing, a chute, not shown, guides the support sheets 52 to a catch tray, also not shown, for removal by an operator.

After the support sheet 52 has separated from the photoreceptor belt 10, residual toner particles on the image area are removed at cleaning station L via a cleaning brush contained in a housing 66. The image area is then ready to begin a new marking cycle.

The various machine functions described above are generally managed and regulated by a controller which provides electrical command signals for controlling the operations described above.

Figure 3:
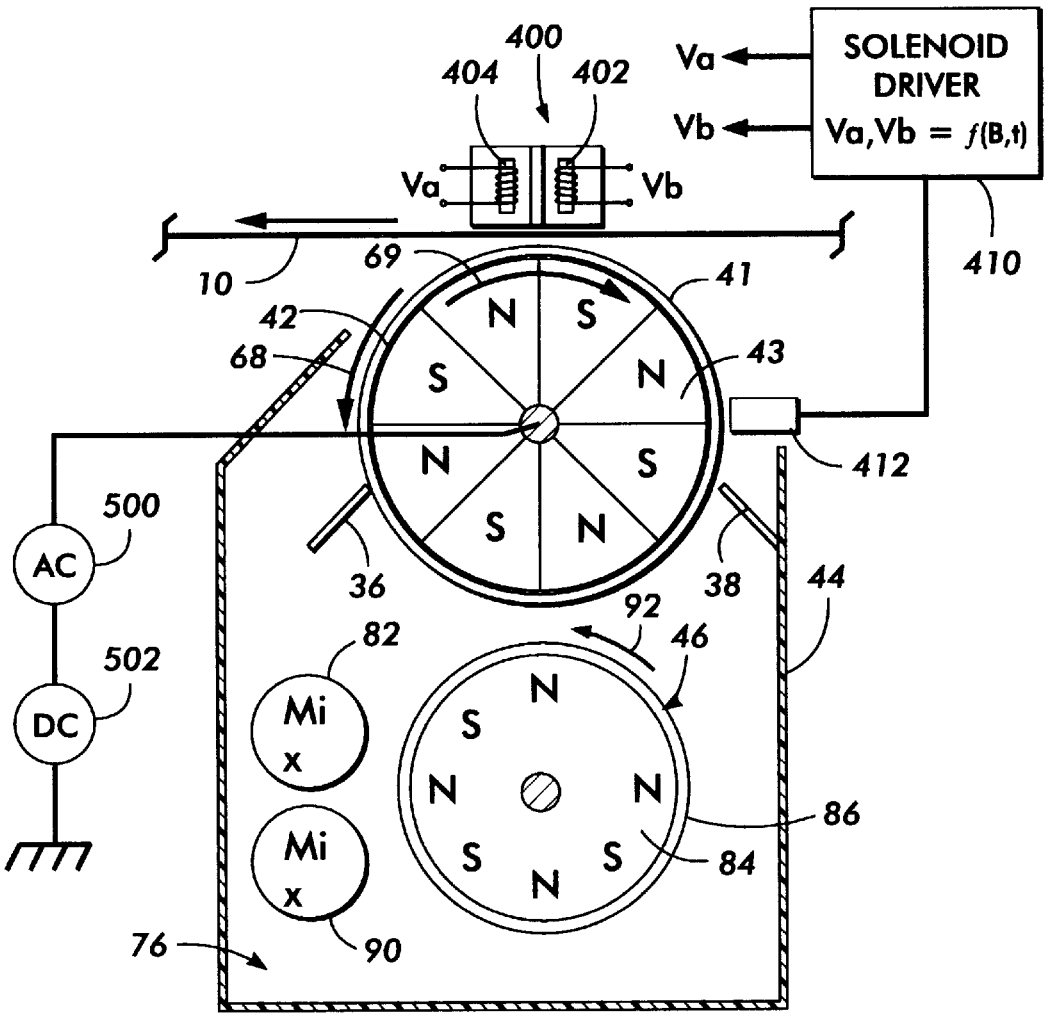
FIG. 3 is a schematic elevational view showing the development apparatus used in the FIG. 1 printing machine.

Referring now to FIG. 3 in greater detail, development system 34 includes a housing 44 defining a chamber 76 for storing a supply of developer material therein. Donor roll 42 comprises an interior rotatable harmonic multipole magnetic assembly 43 and an outer sleeve 41. The sleeve can be rotated in either the "with" or "against" direction relative to the direction of motion of the photoreceptor belt 10. Similarly, the magnetic core can be rotated in either the "with" or "against" direction relative to the direction of motion of the sleeve 41. In FIG. 3, sleeve is shown rotating in the direction of arrow 68 that is the "with" direction of the belt and magnetic assembly is rotated in the direction of arrow 69. Blade 38 is placed in near contact with the rotating donor roll 42 to trim the height of the developer bed. Blade 36 is placed in contact with the rotating donor roll 42 to continuously remove developer from the roll for return to the developer chamber 76.

Magnetic roller 46 advances a constant quantity of developer onto donor roll 42. This ensures that donor roller 42 provides a constant amount of developer with an appropriate toner concentration into the development zone. Magnetic roller 46 includes a non-magnetic tubular member 86 (not shown), made preferably from aluminum and having the exterior circumferential surface thereof roughened. An elongated magnet 84 is positioned interiorly of and spaced from the tubular member. The magnet is mounted stationary and includes magnetized regions appropriate for magnetic pick up of the developer material from the developer chamber 76 and a nonmagnetized zone for developer material drop off. The tubular member rotates in the direction of arrow 92 to advance the developer material adhering thereto into a loading zone formed between magnetic roller 46 and donor roller 42. In the loading zone, developer material is preferentially magnetically attracted from the magnetic roller onto the donor roller. Augers 82 and 90 are mounted rotatably in chamber 76 to mix and transport developer material. The augers have blades extending spirally outwardly from a shaft. The blades are designed to advance the developer material in a direction substantially parallel to the longitudinal axis of the shaft.

Magnetic field tailoring unit 400 is positioned opposed to roll 42 with the photoreceptor belt 10 interposed therebetween. Magnetic tailoring unit includes an arrangement of solenoids, one or more, which can be driven in response to the magnetic field presented by the donor roller 42 in the development zone. In FIG. 3 two solenoid units 404 and 402 are shown for the purpose of magnetic field tailoring. The voltage is supplied to each solenoid by the magnetic control processor 410 to generate a known magnetic field value in the development zone region. Magnetic control processor includes a hall effect sensor 412, which provides means to deduce the instantaneous magnetic field configuration in the development nip of the roll. This sensor output is applied as the signal input for the magnetic control processor to adjust the solenoid drive voltages to each solenoid $V_a$ and $V_b$ to obtain a desired magnetic field in the development zone.

Figure 4:
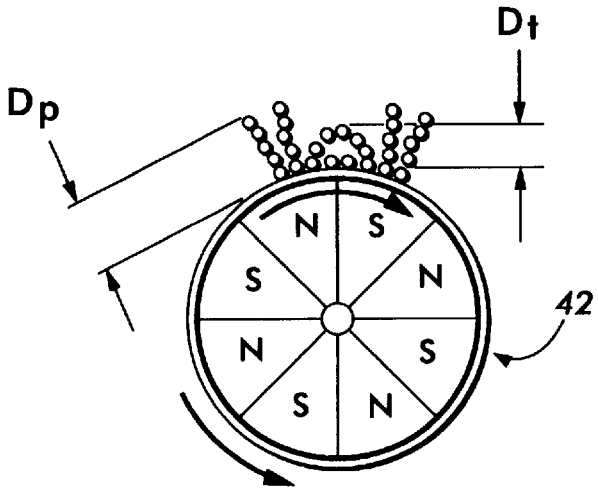
FIG. 4 illustrates variations in the developer bed height.

Developer material, consisting of permanently magnetized carrier particles and toner, is magnetically attracted toward the magnetic assembly of donor roller 42 forming brush filaments corresponding to the magnetic field lines present above the surface of the sleeve 41. It is observed that carrier beads tend to align themselves into chains that extend normal to the development roll surface over pole faces and lay down parallel to the roll surface between pole faces where the magnetic field direction is tangent to the roll surface. The net result is that the effective developer bed height varies from a maximum over pole face areas to a minimum over the pole transition areas. This effect is illustrated in FIG. 4. Rotation of the magnetic assembly causes the developer material, to collectively tumble and flow due to the response of the permanently magnetic carrier particles to the changes in magnetic field direction and magnitude caused by the internal rotating magnetic roll. This flow is in a direction "with" the photoreceptor belt 10 in the arrangement depicted. Magnetic agitation of the carrier which serves to reduce adhesion of the toner particles to the carrier beads is provided by this rotating harmonic multipole magnetic roll within the development roll surface on which the developer material walks.

In the desired noninteractive development mode carrier beads must be prevented from touching the photoreceptor surface or any previously deposited toner layers on the photoreceptor. This is to prevent disturbance of the previously developed toner image patterns that are being combined on the photoreceptor surface to create composite color images. The variation in developer bed height illustrated in FIG. 4 forces the minimum spacing between the photoreceptor and the developer bed surface to be determined by the bed height at the pole areas where the bed height $D_p$ is largest in order to prevent interaction. The average spacing achieved in this manner is then determined by the average bed height which will be greater than the minimum bed height—i.e. $(D_p+D_t)/2>D_t$.

The present invention minimizes the peak developer bed height, $D_p$, and reduces variation in developer bed height that occurs within the development nip to thereby enable a reduction in the effective development electrode spacing to enhance image quality.

In the present invention magnetic fields within the development nip are tailored to prevent the changes in developer bed height that occur external to the nip. In particular, it is proposed that within the development nip region magnetic field components normal to the donor roller 42 surface be eliminated, or at least reduced, and only tangential magnetic fields allowed. Since formation of the bead chains causing the larger developer bed height $D_p$ is due to carrier particles lining up with the normal component of magnetic field, elimination of the normal component will maintain the bed height at, or close to is minimum $D_t$. FIG. 3 illustrates one approach to achieve this magnetic field tailoring effect. In this approach solenoid units 404 and 402 positioned behind the photoreceptor surface would be appropriately energized to achieve the desired magnetic field tailoring. These solenoids may be incorporated into the backer bar in the case of a belt photoreceptor or simply positioned with the core of a drum photoreceptor arrangement. FIG. 3 illustrates the closed loop system with magnetic field tailoring control unit to synchronize solenoid activation with the motion of the rotating magnetic roller 43. Two solenoids have been included along with a magnetic shield between them in order to emulate the traveling magnetic field due to the rotating magnetic roller 43 by appropriately varying solenoid currents. In essence, normal field neutralization requires bucking the traveling normal magnetic donor roll field with an identical opposing normal magnetic field. This achieves the desired reduction in developer bed height and reduction in bed height variation in the development nip necessary to reduce the gap between the donor roller 42 and the surface of the photoreceptor thereby enabling for improved image quality without disturbing interactive effects.

Figure 5:
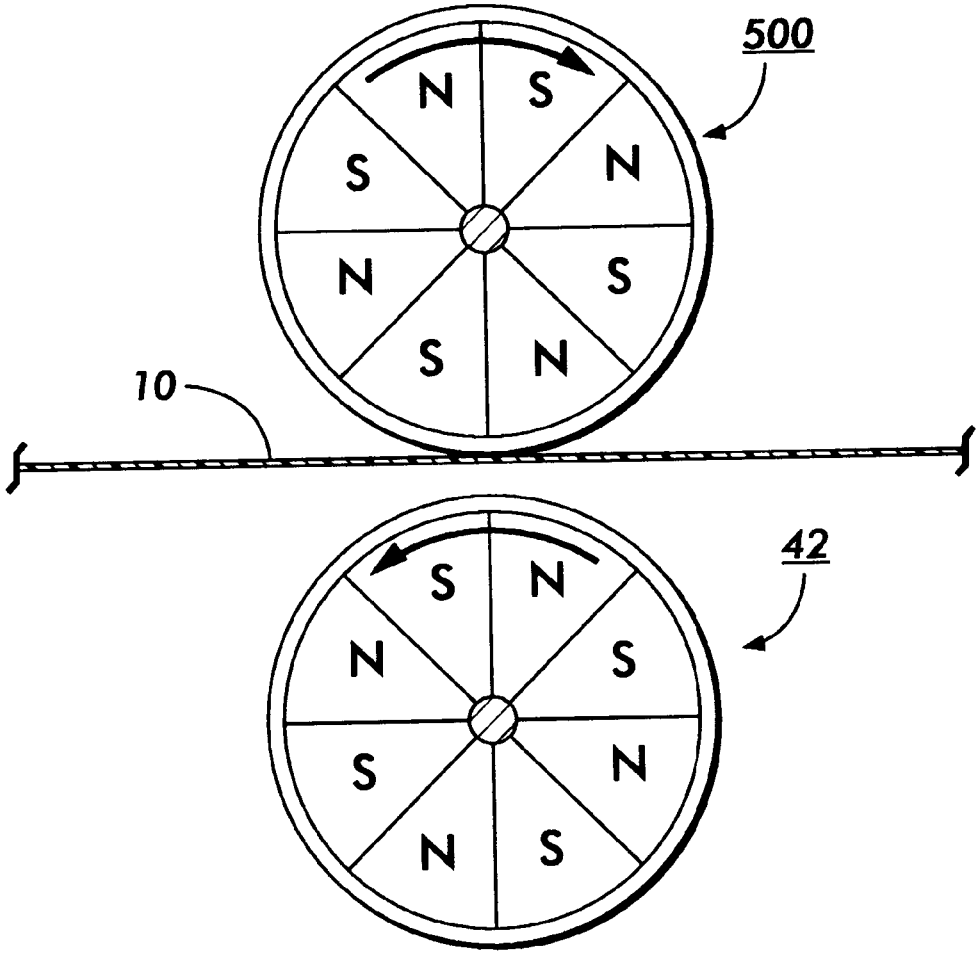
FIG. 5 is another embodiment of the present invention.

Referring to FIG. 5, as an alternative to the electronic servo closed loop approach suggested in FIG. 3, a second rotating magnetic element represents a mechanical option to achieve the same desired result. As shown in FIG. 5, the development roll 42 faces a photoreceptor supporting element (backer roll 500) that contains a similar rotating magnetic roll with the photoreceptor belt positioned between the two roller surfaces. In the case of a drum photoreceptor the rotating magnetic roller 500 is simply positioned with the core of the photoreceptor drum or could in fact be an integral part of the photoreceptor drum structure. Relative pole positions between roll 500 and 42 would have north facing north and south facing south. As indicated the same hardware component may be applied for the donor roller 42 and the magnetic field tailoring roller 500. It is not necessary to rotate the sleeve of the backer roller 500. A simplification would be to reduce the size and number of poles in the backer roll magnet. A small 2 pole device, for example, rotating at higher speeds such that the number of magnetic pole transitions per second are the same as that of the magnetic core of the developer roll would represent an attractive design to minimize space requirements.

In recapitulation the present invention provides a means to enable closer spacing of the photoreceptor to the donor roller by minimizing the peak developer brush filament lengths and reducing the variation in developer bed heights in the development zone for enhanced copy quality. In addition to enabling closer spacing to the developer bed (and hence closer to the effective development electrode) elimination, or at least reduction, of the normal magnetic field components in the development nip will reduce the tendency for carrier beads to deposit on the photoreceptor surface. Reduced bead (or bead fragment) carryout is an additional attribute of this approach. While the invention has been described with reference to the structures disclosed, it is not confined to the specific details set forth, but is intended to cover such modifications or changes as may come within the scope of the following claims:

What is claimed is:

1. In a non-interactive magnetic development system including a developer transport adapted for depositing developer material on an imaging surface having an electrostatic latent image thereon, comprising:

a housing defining a chamber storing a supply of developer material comprising toner;

a donor member, mounted partially in said chamber and spaced from the imaging surface, for transporting developer on an outer surface thereof to a development zone opposed from the imaging surface, said donor member having a magnetic assembly having a plurality of poles, a sleeve, enclosing said magnetic assembly, rotating about said magnetic assembly;

a sensor for sensing magnetic field configuration of said magnetic assembly at a predefined position on said donor roll; and means, responsive to said magnetic field configuration sensed, for generating a development magnetic field in said development zone to substantial reduced a normal component of said magnetic field of said magnetic assembly when said predefined position reaches the development zone thereby reducing developer bed height of said developer material on said donor member within the development zone so that the developer bed height does not interact with the imaging surface.

2. The development system of claim 1, wherein said generating means includes a solenoid assembly which generates said magnetic field in the development zone.

3. The development system of claim 1, further comprising a control system, responsive to said sensor, for controlling said solenoid assembly.

* * * * *